United States Patent [19]

Marvin

[11] Patent Number: 5,016,777

[45] Date of Patent: May 21, 1991

[54] EXPANDABLE POLYSTYRENE CONTAINER HINGE AND METHOD OF FORMING

[76] Inventor: Morley Marvin, R.D. 1, Canastota, N.Y. 13032

[21] Appl. No.: 463,526

[22] Filed: Jan. 11, 1990

[51] Int. Cl.[5] ..... B65D 43/16

[52] U.S. Cl. ..... 220/339

[58] Field of Search ..... 220/339; 229/2.5, 25 EC

[56] References Cited

U.S. PATENT DOCUMENTS

| | | | |
|---|---|---|---|
| 3,447,199 | 6/1969 | Trimble | 220/339 |
| 3,551,940 | 1/1971 | Edison | 220/339 |
| 3,596,822 | 8/1971 | Holley | 220/339 |
| 3,629,901 | 12/1971 | Wolf | 220/339 |
| 3,800,998 | 4/1974 | Gask | 229/2.5 |
| 3,868,054 | 2/1975 | Gongleton | 229/2.5 |
| 3,900,550 | 8/1975 | Oliver | 220/339 |
| 3,907,193 | 9/1975 | Heller | 220/339 |
| 4,127,189 | 11/1978 | Shumrak et al. | 220/2.5 |
| 4,403,712 | 9/1983 | Wiesinger | 220/339 |
| 4,406,362 | 9/1983 | Thomas et al. | 220/339 |
| 4,454,958 | 6/1984 | Juillet | 220/339 |
| 4,553,692 | 11/1985 | Padovani | 220/339 |
| 4,713,219 | 12/1987 | Gerken | 220/339 |
| 4,753,351 | 6/1988 | Guillin | 220/339 |
| 4,858,781 | 8/1989 | Kane | 220/339 |
| 4,911,324 | 3/1990 | Dubach | 220/339 |

*Primary Examiner*—Stephen Marcus
*Assistant Examiner*—S. Castellano
*Attorney, Agent, or Firm*—Wall and Roehrig

[57] ABSTRACT

A molded Expandable Polystyrene box having a top and a bottom hinged along one edge is provided with a dual hinge in which, each hinge portion folds only 90° to form a 180° closure of the top and the bottom. The hinges are formed by molding longitudal indentations on either side of a semi-arcuate reinforcing spine together with clearances in an integral web joining the top and bottom. The indentations are highly compacted into solid plastic so that the hinge can be flexed repeatedly without breaking.

2 Claims, 1 Drawing Sheet

EXPANDABLE POLYSTYRENE CONTAINER HINGE AND METHOD OF FORMING

BACKGROUND OF THE INVENTION

This invention relates to plastic hinges and more particularly to an integral hinge formed in a molded plastic container.

Historically plastic articles such as Expandable Polystyrene beads have been molded into cartons and boxes for containing merchandise and the like for a wide variety of packaging applications. Initially, the top was made as a separate piece from the bottom and was held on with a tie or plastic tape when it was desired to close the container. Another common use of this type of packaging was to place the Expandable Polystyrene container top and bottom, in a cardboard sleeve that would hold them together. Gradually attempts have been made to form a hinge in the plastic by compressing the plastic into a narrow longitudinal trough along one edge joining a top and bottom, which can be readily bent to permit the closure of the top onto the bottom.

"Living" hinges of various types have been available in plastics such as polypropylene and polyethylene wherein by heat and pressure a linear indentation is made that permits the bending of the plastic sheet along this thinned and formed section of the basic plastic sheet. For foamed plastic containers such as those made from Expandable Polystyrene where the density of the plastic is substantially less, it has been found, a hinge of this type has insufficient structural tensil and bending strength. Heretofore a "hinged" Expandable Polystyrene container could only be bent a very few times before breaking completely apart.

OBJECTS AND SUMMARY OF THE INVENTION

Accordingly, it is an object of the present invention to provide an improved hinge for Expandable Polystyrene and the like containers. It is another object of the present invention to provide a hinge in a molded Expandable Polystyrene container as an integral part thereof. It is another object of the present invention to provide a molded Expandable Polystyrene container having a top and bottom integrally hinged together along one edge thereof. It is still further object of the present invention to provide a molded Expandable Polystyrene container having a top and bottom hinged along one edge thereof, such that the top can be closed and opened a large number of times. It is still further object of the present invention to provide a molded Expandable Polystyrene container having a top and bottom with an integral connecting hinge formed along one edge of the top and bottom thereof.

These and other objects are attained by forming an integral web along one edge of the top and bottom of a container and providing a pair of elongated compacted indentations on either side of a semi-arcuate spine member in said web between said top and bottom.

BRIEF DESCRIPTION OF THE DRAWINGS

Further objects and advantages of the present invention may be more fully understood by reference to the drawings in which.

DETAILED DESCRIPTION OF THE PREFERRED EMBODIMENT

Figure 1:
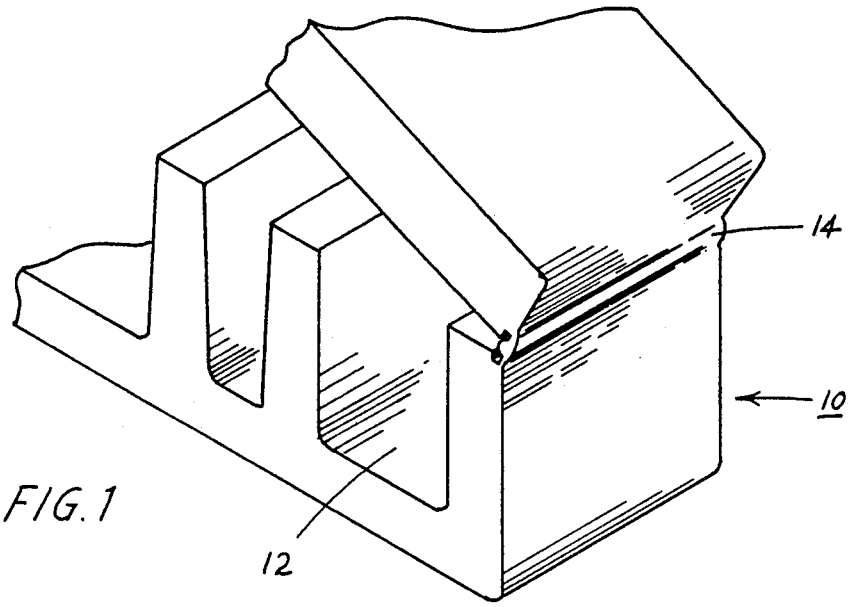
FIG. 1 is a partial perspective view of a container according to the present invention.

Referring now to FIG. 1 there is shown a container 10 comprising a molded container of Expandable Polystyrene or similar type plastic formed by filling a mold with a plurality of beads of the material to form the container and then compressing and heating the plastic beads until they form a homogeneous mass approaching a foam, in which a large percentage of the volume of the container is air dispersed throughout the plastic mass. Various recesses and pockets 12 can be formed in such a container to receive articles to be packaged. The top generally is shallower than the bottom with fewer receptacles and indentations but, having a configuration that will mate with the bottom when placed thereon. As can be seen a hinge assembly 14 is formed along the edge of the top and the bottom flexibly joining the top to the bottom.

Figure 2:
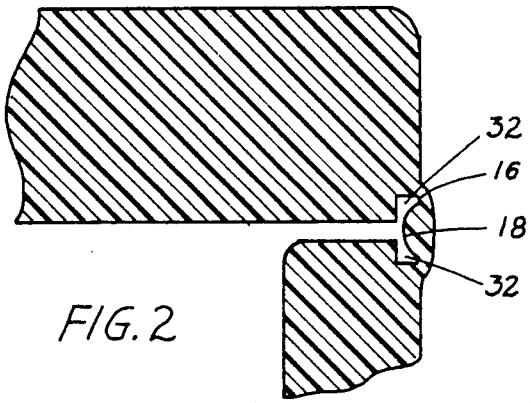
FIG. 2 is cross-sectional view through the hinge of the present invention when in the closed configuration.
Figure 3:
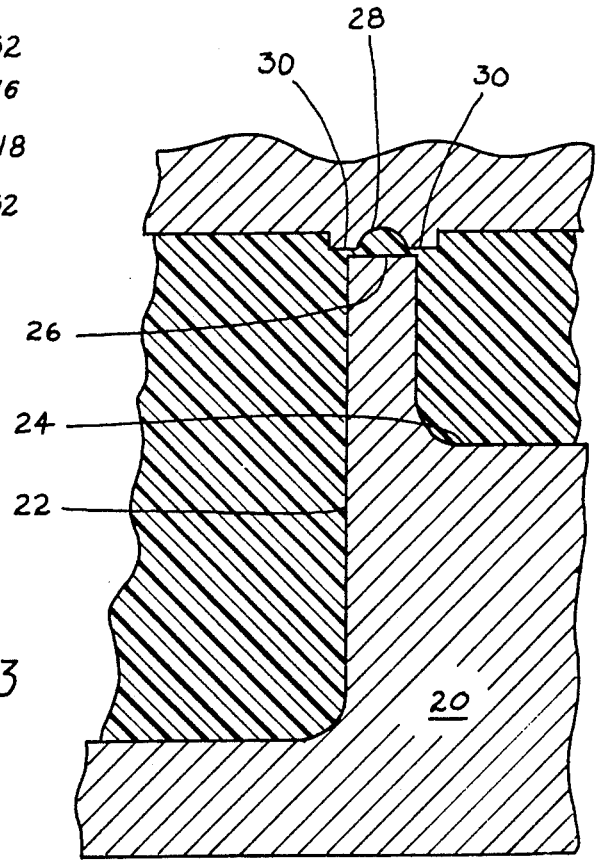
FIG. 3 is cross-sectional view of a portion of a mold for forming a Expandable Polystrene container top and bottom, with the top hinged to the bottom along one edge.

As may be seen more clearly in FIGS. 2 and 3 the hinge 14 is formed by a pair of parallel compressed indentations 16. These elongated indentations are formed in the Expandable Polystyrene beads by increased heat and compressing of the beads into essentially solid plastic. The indentations are spaced apart by a semi-arcuate rib portion 18 which forms a backbone for the folding of the hinge sections 16 to permit the top to be bent over along one side and closed into mating relationship with the bottom. Rib 18 has a density essentially the same as the top and bottom of the container.

Since it is usually desirable to be able to open a box and have the top lay flat so that the bottom can be easily loaded with the goods to be packaged, the hinge in effect has to be able to fold through 180°.

Thus, any integral hinge member along one edge of a top and bottom must be able to permit this full 180° bending of the molded formed plastic. As indicated above this has placed very great stress along the hinge line and has in the prior art, frequently been the cause of breakage and failure of the molded Expandable Polystyrene hinge.

Accordingly in the present invention I provide a pair of compressed indentations 16 on either side of rib 18, so that each "hinge portion" only has to bend 90° instead of 180°. Thus, as may be seen in FIG. 2, when the box is closed each indentation 18 has actually only been stressed to a 90° configuration. It should be noted that in addition to each portion only bending 90° the central arcuate rib portion 18 has a radius substantially greater than its width so that at each end of the arc as it intersects the unbent plane of the hinge member, the angle of 25 intersection is less than 90°. Thus, as each hinge indentation is bent up 90° the reinforcing spine 18 in the middle will not touch the adjacent hinged portion of the top or bottom to interfere with the 90° hinging action along the compacted hinge indentation. The hinge indentation on one side of rib 18 will fold 90° and on the other side the other hinge indentation will fold 90° and the complete assembly thus has achieved the 180° closure required for a top and bottom. The two hinge sections as they fold up the full 180° will cause the spine or rib portion 18 to project out slightly from the surface of the top and bottom edge when in the closed condition, as may be seen in FIG. 2.

With the indentations 16 being substantially solid plastic, repeated flexing of these hinge indentations can be obtained without tearing or breaking the compacted plastic material.

Referring now to FIG. 3 the hinge is formed by preparing a mold 20 for the container having a bottom forming section 22 and a top forming section 24 together comprising the mold bottom member which is closed by top member 25 for the heating and fusing of the plastic material. Adjacent the junction of the top and bottom edges there is provided a flat plateau portion 26 which extends across the width of the hinge area on what will be the outside of the hinge after molding. Opposite this plateau member and centered thereon in the cover portion of the mold is an arcuate spine portion 28 that is concave in configuration. A pair of legs 30 on either side of the reinforcing spine section 28, extend dowardly from the top mold member so as to come into close juxtaposition with the plateau member 26 on each edge thereof. To form the hinge portion, the top mold member is aligned with the bottom mold member in the usual fashion and is spaced from the bottom mold an amount sufficient to allow the mold to be fully filled with the plastic particles to be heated, and fused into the container. The exact spacing of the top from the bottom will be determined by the composition of the plastic material to be molded, the desired density of the finished product and the stress to be encountered as is well known in the molding art.

The hinge portion is then heated with steam and the mold closed to compress and fuse the two hinge indentations 16 into essentially solid Expandable Polystyrene on either side of the spine. The rest of the container is then steam heated to fuse the Expandable Polystyrene beads into the desired homogeneous mass.

In one particular application it has been found that, for the hinge indentations 16, a reduction from "open" to "fully compressed" condition of approximately 10 to 1, is about optimum for a Expandable Polystyrene container. (i.e. ¼" of Expandable Polystyrene beads is compressed to 0.025" of substantially solid plastic.) It has been found that the hinge indentations 16 must be essentially solid plastic material with very little air entrapped therein, in order to have the required strength to be repeatedly flexed. A compressed thickness of 0.025" or less has been found to offer good flexibility. In a particular container it has been found that if the plateau member 26 is a ¼ of an inch wide, and the outside dimension of the two legs 30 is ⅜ of an inch, and the reinforcing spine is chosen as having a radius of 0.094 inches and a depth into the cover mold member of 0.06 inches, the mold must be closed down to approximately 25 thousandths (0.025") clearance between the two outer edges of the plateau member and legs 30. The legs 30 extend downwardly 0.060" from the top mold member and have a width of 0.375". It thus forms the two thinned 0.025 thick indentations 16 on the top of plateau 26 and then extends outwardly from each channel 0.0625 inches, which effectively forms a pair of clearances 32 for the top of the radius of reinforcing spine 18 when the hinge is closed to the full 180° fold condition as may be seen in FIG. 2.

In the forgoing example, the Expandable Polystyrene container was molded of Expandable Polystyrene beads having a density of 1.5 pounds per cubic foot and heated sufficiently to fuse the Expandable Polystyrene beads together to form a homogeneous container hinged together by the substantially solid Expandable Polystyrene indentations which increase the structural strength to the point that repeated flexing will not cause cracking of the two hinge indentations 16. Because of the configuration as described above and clearance channels 32, separating stresses imposed on the hinge by closing the cover, are eliminated.

The configuration of the present invention thus, provides a double hinge arrangement that requires less flexing of each hinge section, a stronger fully compacted hinge indentation, and also clearance such that there is no tearing or stretching of the hinge. Finally a reinforcing spine is provided between the hinge indentations to strengthen the hinge assembly. Altogether a superior hinge member for a molded plastic container formed from Expandable Polystyrene beads is provided.

While this invention has been explained with reference to the structure disclosed herein, it is not confined to the details as set forth in this application, it is intended to cover any modifications and changes as they come within the scope of the following claims.

What is claimed is:

1. A container molded of expandable polystyrene beads having a top section and a bottom section that are hinged along one edge, said bottom section having side walls that terminate in a plane that describes the top surface of said bottom section, said top section having side walls that terminate in a plane that describes the bottom surface of said top section so that the bottom surface of the top section can close against the top surface of the bottom section, a hinge integral with the two sections that joins one sidewall edge of the top section with an adjacent sidewall edge of the bottom section, said hinge having a web of a predetermined width joined to the adjacent sidewall edges and a raised rib centered upon the web between the adjacent sidewall edges, the width of the rib being less than the width of the web, the beads in the web on either side of the rib being compressed to a solid, each adjacent sidewall edge having a recessed shoulder formed along the edge thereof so that the bottom surface of the shoulders are in coplanar alignment with the top surface of the web when the top and bottom sections are turned 180° to an opened position and said shoulders having a width to provide clearance for the rib when the top and bottom surfaces of the container sections are closed against each other to house the rib within the shoulders without contact between the rib and the shoulders.

2. A container molded of expandable polystyrene beads according to claim 1 wherein the beads in the web on either side of the rib are compressed to a thickness not exceeding 0.025 inches.

* * * * *